US008733042B2

(12) United States Patent
Daniocek et al.

(10) Patent No.: US 8,733,042 B2
(45) Date of Patent: May 27, 2014

(54) INSULATED AND EFFICIENT BASEBOARD CONSTRUCTION

(76) Inventors: Jeffrey Daniocek, Sheffield Village, OH (US); Thomas L Peck, Sheffield Village, OH (US)

( * ) Notice: Subject to any disclaimer, the term of this patent is extended or adjusted under 35 U.S.C. 154(b) by 0 days.

(21) Appl. No.: 13/348,816

(22) Filed: Jan. 12, 2012

(65) Prior Publication Data

US 2012/0210667 A1 Aug. 23, 2012

Related U.S. Application Data

(60) Provisional application No. 61/444,463, filed on Feb. 18, 2011.

(51) Int. Cl.
*E04B 2/00* (2006.01)

(52) U.S. Cl.
USPC ..... 52/287.1; 52/716.1; 52/273; 52/716.2; 52/309.4; 52/290

(58) Field of Classification Search
USPC ..... 52/588.1, 716.1, 716.8, 717.02, 718.04, 52/717.04, 288.1, 290; 428/119
See application file for complete search history.

(56) References Cited

U.S. PATENT DOCUMENTS

| | | | | | |
|---|---|---|---|---|---|
| 1,755,545 | A * | 4/1930 | Lacey | 52/220.1 |
| 3,161,926 | A * | 12/1964 | Schaub | 52/288.1 |
| 3,616,113 | A * | 10/1971 | Sawyer | 220/683 |
| 3,942,295 | A | 3/1976 | Schacht | |
| 4,109,434 | A * | 8/1978 | Katzin | 52/288.1 |
| 4,706,427 | A * | 11/1987 | Zeilinger | 52/287.1 |
| 5,157,886 | A * | 10/1992 | Azzar et al. | 52/717.05 |
| 5,243,800 | A * | 9/1993 | Olbrich | 52/287.1 |
| 5,553,431 | A * | 9/1996 | Pelosi et al. | 52/287.1 |
| 5,557,895 | A * | 9/1996 | Bendrell | 52/220.7 |
| 6,189,276 | B1 * | 2/2001 | Pinto et al. | 52/288.1 |
| 6,233,882 | B1 * | 5/2001 | Breaux | 52/98 |
| 6,578,332 | B2 * | 6/2003 | Bushberger | 52/293.3 |
| 6,643,990 | B2 * | 11/2003 | Jensen | 52/716.1 |
| 7,128,585 | B2 * | 10/2006 | Evilsizer | 439/120 |
| 7,255,152 | B2 | 8/2007 | Friedlich | |
| 7,574,836 | B2 * | 8/2009 | Wesolowska | 52/288.1 |
| 7,594,368 | B2 * | 9/2009 | Kurz | 52/290 |
| 7,614,190 | B2 * | 11/2009 | Cooper | 52/211 |
| 2004/0040235 | A1 * | 3/2004 | Kurtz | 52/288.1 |
| 2005/0257485 | A1 * | 11/2005 | Hahn | 52/716.1 |
| 2007/0277473 | A1 | 12/2007 | Richardson | |

* cited by examiner

*Primary Examiner* — Robert Canfield
*Assistant Examiner* — Matthew Gitlin
(74) *Attorney, Agent, or Firm* — Daniel Boudwin; Global Intellectual Property Agency LLC

(57) ABSTRACT

A baseboard structure having air gap insulation, an integrated quarter-round molding segment, and an upper caulk channel for providing a unitary baseboard element for rapid and improved installation. The baseboard comprises an outer, decorative surface having an integrated quarter round element, a lower surface adapted to lie flush on a floor surface, a backside surface and an upper caulk channel. A section of compressible insulation material is located at the junction of the backside and lower surfaces, and is adapted to be pressed into any gaps between the flooring and the wall to seal any air gaps or gaps in thermal resistance. The device incorporates a caulking channel at the junction of the backside and outer surfaces such that the installer may create a seamless transition between the top of the baseboard and the wall with a quantity of caulk while the baseboard lower surface lies flush with floor.

3 Claims, 2 Drawing Sheets

INSULATED AND EFFICIENT BASEBOARD CONSTRUCTION

CROSS REFERENCE TO RELATED APPLICATION

This application claims the benefit of U.S. Provisional Application No. 61/444,463 filed on Feb. 18, 2011, entitled "1-Step EZ Base."

BACKGROUND OF THE INVENTION

1. Field of the Invention

The present invention relates to baseboards and baseboard installation methods. More specifically, the present invention describes a baseboard molding having a segment of integrated quarter-round molding, a strip of compressible insulating material and a caulking channel the baseboard upper. The present device improves upon existing baseboards by providing an efficient mounting process that eliminates steps during installation, provides added thermal resistance once installed to prevent drafts within the home and allows easy installation onto non-plumb interior corners.

2. Description of the Prior Art

Many individuals derive a sense of pride and ownership by undertaking a do-it-yourself flooring project, while other homeowners contract a professional installer to perform the installation. Updating the flooring in one's home often requires the installation of new baseboards to disguise or conceal the seam that results at the junction of the new flooring and the upstanding walls of the room. Baseboards are structures that provide a decorative outer fascia to conceal this junction, and can greatly update the quality and style of a room. Installation of baseboard molding at the base of the walls within a room further provides the room with a finished look.

Traditionally, the process of installing new baseboards is time consuming, labor intensive and a tedious process entailing several steps. First, the base molding requires trimming by an installer to the appropriate length for each wall. Next, the individual mounts the baseboard molding against the wall and floor, concealing the intersection where the wall and the floor meet and creating joints between adjacent sections of baseboard. After tacking the baseboard into position, generally a seam results between the newly lain baseboard molding and the floor, which is concealed by a section of quarter-round molding that is then tacked against the base of the baseboard. The quarter-round trim is a section of molding that is quarter-cylinder shaped and conceals any seam at the bottom of the baseboard. Installation of quarter-round molding requires hammering finishing nails into the quarter-round molding, which secures the quarter-round to the wall and/or flooring, and then filling or covering the nail heads with caulk, putty or paint. Once dry, the caulk or putty is sanded, which gives the quarter-round molding a smooth exterior finish. Several steps are required in order to achieve this finished look, otherwise gaps will show and nail heads will be visible. The present invention provides a means to bypass most of these tedious steps, accelerating and streamlining the installation process for both professional installers and do-it-yourselfers.

Proper installation of baseboards requires that the baseboard be flush with both the wall and the floor, which can pose a challenge upon installation, as most wall and floor surfaces are not precisely planar and plumb (perpendicular) with regards to one another. It is often necessary to incorporate a quantity of filler material to close any discontinuities or gaps between the installed baseboard and the upstanding wall surface. This is generally completed by filling in the gap with a line of caulk prior to painting the surfaces. Caulk is often used at the top of a baseboard while the baseboard lies flush against the ground floor and the quarter round section conceals any gaps along the base. Upon completion of the installation process, the newly-installed baseboard can receive a coat of paint to provide an aesthetically pleasing transition between the wall and the floor, which is often an interior decor characteristic highly sought after by home owners. The present invention addresses the caulking procedure at the top of the baseboard by providing a channel that facilitates improved caulk application and gap filling with minimal overflow.

Overall, the present invention comprises a baseboard structure having a built-in quarter-round molding segment that is not separately installed. The one-piece construction of the baseboard allows for swift installation without finishing nails or coverage thereof using a separate quarter round segment. As the baseboard and the quarter-round molding are one piece, there is no need to install the baseboard first and then the quarter-round molding thereafter. During installation, an installer presses the baseboard flush against the floor and tacks the baseboard to the wall. If the wall and floor are not plumb, a gap may exist at the top of the baseboard. The present invention provides a unique caulking channel to address this issue, wherein a quantity of caulk may be placed therein to eliminate any existing gaps. Overall, the elements of the present invention improve current installation procedures and facilitate rapid installation of an interior baseboard.

A further concern related to the junction between an interior wall of a room and the floorboards are open air gaps. An air gap forms when the floor boards do not completely abut against the drywall or wall frame. Insulation behind the drywall eliminates most of the heat transfer across the free field area of the wall surface, but at this corner region, gaps may exist at the termination of the insulation that provide conduits for air to filter into the dwelling. This can result in a gap of thermal resistance that can lead to drafts in an interior space, as air travels across the gap, leaking hot air out or letting hot air enter the room. The present invention provides a strip of insulating material along the backside surface of the baseboard that compresses into this corner gap as the baseboard is pressed against the wall and floor. The insulation expands to fill and insulate any gaps that exist under the baseboard, between the flooring and the wall. Overall thermal efficiency of the interior space is improved, as heat is prevented from leaking across gaps behind baseboard.

Several patents exist that attempt to address concerns regarding baseboards and the baseboard installation process. For example, U.S. Pat. No. 7,255,152 to Friedlich describes a baseboard and molding system designed to facilitate heat transfer between the atmosphere of a room and a concealed heater hidden within the wall, behind the baseboard. The heater consists of a series of conduits, which carry heated fluid. The conduits pass through and attach to a multitude of heat exchanging fins. The increase the amount of surface area exposed to the air where heat exchange can take place, thus enhancing the heating capabilities of the system. The baseboards associated with the Friedlich device are meant to conceal the heat exchange system by having an outward appearance like that of a normal baseboard with a uniform external surface configuration. The heating system is undetectable behind the baseboards. One embodiment of the Friedlich device features a baseboard with a segment of the baseboard that extends away from the heating system a small distance forming an airway behind the baseboard. This allows heated air to escape from the space within the wall and facilitates heat transfer.

Installation of the Friedlich device is a highly complicated process as it first involves the installation of a heating system within the walls of an area to be enclosed by the heating system, and then requires the installation of the baseboards to conceal the heating system. Further, any repair that needs to be made to the heating system necessitates the removal of the baseboard to access the heating system. The present invention installs quickly and easily and should not require removal for any reason once installed. Installing the present invention baseboard molding requires only that an installer insulate the space between the flooring and the wall by mounting the baseboard to the wall and then finishing the top of the baseboard with caulk. Installation of the present invention does not require the use of specialized tools. Further, the intent and spirit of the Friedlich device differ considerably from the present invention.

U.S. Pat. No. 3,942,295 to Schacht describes a corner fitting for use in conjunction with baseboard molding. A common problem encountered during the installation of baseboards is that it is challenging to create an aesthetically pleasing transition at the sharp projecting corners of a room. More specifically, the corner where two walls converge forms a corner that projects outward into the room. The Schacht device fits on any projecting corner, underneath the baseboard, leaving only a small corner-rounding piece, or corner fairing, of quarter-round molding visible at the base of the wall. The device creates an aesthetically pleasing corner piece that lies flush with the floor, smoothing the transition between the floor and the wall. The Schacht device comprises two wings joined at a flexible midsection. Each wing has an upper, wall-mounting portion of the wing and a lower, floor-mounting portion which forms a ninety degree angle away from the wall to which the device mounts and lies flush with the floor. The structure and intent of the Schacht device differs from the present invention, which provides a novel baseboard that improves upon traditional installation procedures and provides an added layer of insulation.

U.S. patent application No. 2007/0277473 to Richardson is another such device that describes a system of interlocking baseboard segments. The system comprises decorative baseboard panels, plain baseboard panels, quarter-round molding sections, as well as stylized crown edging pieces that form a smooth transition between the top of the baseboard and the wall. The baseboards components connection to each other before installation along the base of a wall. By employing a series of tongue and groove joints, the pieces are interchangeable, stackable and allow for the user to customize the design and style of the baseboards. The Richardson baseboards are also multifunctional and can also serve as crown molding, chair railing, window framing or as decorative molding along a staircase.

The Richardson baseboard system provides users with a variety of customizable decorative possibilities. Users can choose how many sections to combine and can tailor the overall look of the baseboards to complement the aesthetics of a particular room. Users must make a selection regarding the sections to incorporate into the baseboards, assemble the baseboard and then install the customized baseboards in a room. The present invention is ready to use and requires no assembly prior to installation. Like every baseboard system, the baseboards of the present invention must be trimmed to fit the specific space. Once trimmed, the boards are ready for easy and quick installation. The Richardson device further does not provide a means to quickly fix gaps created between non-plumb surfaces. The present invention provides an integrated quarter-round segment that lies flush along the floor, while a caulking gap allows for any gaps to be quickly filled along the top of the baseboard before painting.

It is therefore submitted that the present invention substantially diverges in design elements from the prior art and consequently it is clear that there is a need in the art for an improvement to existing baseboard moldings. In this regard the instant invention substantially fulfills these needs.

SUMMARY OF THE INVENTION

In view of the foregoing disadvantages inherent in the known types of baseboards now present in the prior art, the present invention provides a new baseboard of unitary construction with incorporated insulating and gap-filling capabilities, wherein the same can be utilized for providing ease and convenience for the user during the installation process while adding improved thermal insulation of the household.

It is therefore an object of the present invention to provide a new and improved baseboard molding that has all of the advantages of the prior art and none of the disadvantages.

It is another object of the present invention to provide a baseboard with an integrated quarter-round molding section, whereby the baseboard and quarter-round are of single piece construction to facilitate rapid installation.

Another object of the present invention is to provide a baseboard structure having improved insulating qualities, whereby a strip of compressible insulating material is incorporated along its lower backside for the purpose of filling and insulating any gaps between the flooring and the wall once installed.

Yet another object of the present invention is to provide a baseboard structure having a caulking channel along its upper to facilitate closure of any gaps that exist once the baseboard is installed flushly against a floor surface and a non-plumb wall.

A final object of the present invention is to provide a baseboard structure that eliminates steps in the installation process when compared to traditional techniques, improving process efficiency and speed of installation.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
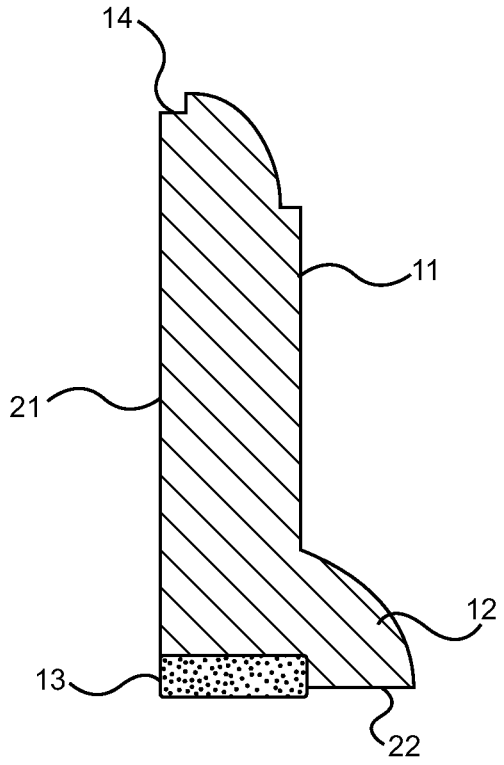
FIG. 1 is a cross section view of the present invention depicting a typical styling of the device and the unitary construction of the baseboard, as well as the caulking channel and compressible insulating material.

Reference is made herein to the attached drawings. Like reference numerals are used throughout the drawings to depict like or similar elements of the one-piece solid baseboard construction. For the purposes of presenting a brief and clear description of the present invention, the preferred embodiment will be discussed as a baseboard used for installation along the base of a wall in a room with updated flooring. The figures are intended for representative purposes only and should not be considered to be limiting in any respect.

Referring now to FIG. 1, there is shown a close up cross section view of an embodiment the baseboard structure of the present invention depicting a typical styling of the device and its unitary construction, as well as the upper caulking channel and air gap insulation. The present invention is a baseboard structure having an outer, decorative surface 11, a backside surface 21, a lower surface 22, and an integrated quarter-round molding element 12 positioned at the base of the outer surface 11. The outer surface includes an integrated quarter-round that during installation is oriented such that it faces away from the wall, while the backside surface is adapted to face the upstanding wall surface and the lower surface is adapted to lie flush against the floor surface. The unitary construction of the baseboard molding reduces the amount of time necessary to install the baseboards, as the extra steps of trimming, aligning and tacking the quarter-round segment are eliminated.

At the junction of the backside and lower surfaces, there is a section of compressible insulating material 13 that extends the entire length of the baseboard. The compressible insulating material 13 is adapted to be pressed into any gaps between the flooring and the wall to seal air gaps or gaps in thermal resistance. The insulating material is slightly oversized, fitting flush with the backside of the baseboard, but extending slightly below the lower side of the baseboard; thus, the insulating material protrudes beyond the lower side of the baseboard to fill any gaps when installed. Varieties of compressible insulating materials may be utilized, including rubber, insulating foam, insulating board or spun insulating fibers such as glass wool. Most wall and floor surfaces are not precisely planar or plumb with one another, necessitating the use of baseboards to conceal any gaps or seams that may exist between the upstanding wall surface and the floor. The present invention utilizes this slightly oversized, compressible insulating material along the backside surface to expand and fill any gaps that may exist at the baseboard boundary.

Along with its unitary construction and insulating strip, the present invention incorporates a caulking channel 14 at the junction of the backside 21 and the outer surface 11. The caulking channel 14 extends the length of the baseboard and facilitates placement of a quantity of caulk at this location for closing any gaps between the outer surface 11 and the upstanding wall. During installation, gaps may exist at the top of the baseboard. These gaps are generally addressed by the application of a quantity of filler, such as caulk or putty. The disclosed channel 14 provides an improved means of accepting the caulk and creating a smooth transition between the outer surface 11 and the upstanding wall once applied and wiped smooth by an installer's finger. Once dried and painted, the caulk resembles a continuous section of the outer surface without indicating the presence of a gap.

Figure 2:
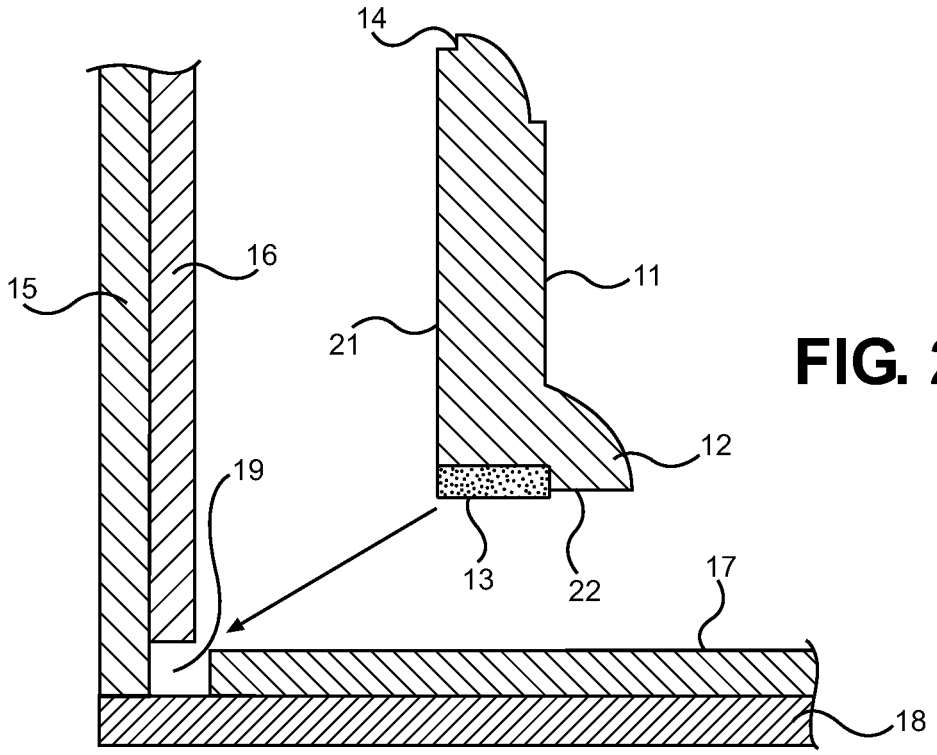
FIG. 2 shows a cross section view of the present baseboard structure being installed along a wall surface wherein a gap exists between the floor and the wall.

Referring now to FIG. 2, there is shown a cross section view of the present baseboard structure being installed along a wall surface wherein a gap 19 exists at the junction of the floor 17 and the wall 16. During the construction of a home, drywall 16 is hung on studs 15 to create a room enclosure. Flooring 17 (tile, hardwood, etc.) is placed on top an existing foundation 18 to create the finished floor of a room. It is common for air gaps or gaps in thermal resistance to exist at the junction where the wall surface 16 and the flooring 17 meet. This corner gap 19 can exist along the length of a wall 16 and allows for air infiltration into and out of a room, lowering thermal efficiency of the dwelling. The present invention provides compressible insulating material 13 that is attached to the backside surface 21 of the baseboard, which is adapted to be pressed into any gaps 19 that exist between the flooring and the wall surface, thereby sealing the corner gap 19 that may exist. Installation of the present invention improves thermal insulation, reduces air infiltration into a room (i.e., drafts) and can result in lower energy expenses for the homeowner.

To install the present invention, an installer orients the baseboard such that the strip of insulating material 13 is targeted to situate into the corner gap located between the floor and the wall surface. This orientation renders the outer, decorative fascia of the baseboard towards the center of the room and facilitates the abutment of the backside and the lower side of the baseboard against the wall surface and the floor surface respectively. The installer presses the baseboard lower surface flush with the floor 17 while pressing the backside surface 21 against the wall 16. In doing so, the insulating material 13 compresses into any corner gap space 19 that exist under the baseboard 11, between the wall 16 and the flooring 17. There is a vast array of attachment mechanisms for securing the baseboard to a wall and floor surface. Which attachment mechanism an installer employs is dependent on the installer's preferences. Cementing material, adhesive backing, glue or nails are all possible attachment means commonly used to attach baseboards to walls. If the baseboard is installed onto a non-plumb wall, the base 22 of the baseboard can be flush against the floor 17 while any gaps between the backside surface 21 and the wall 16 can be filled by placing caulk into the channel 14 to close the gap. Generous application of caulking can be smoothed over by the installer running his or her finger along the channel to create a smooth transition between the outer surface 11 and the wall 16.

Figure 3:
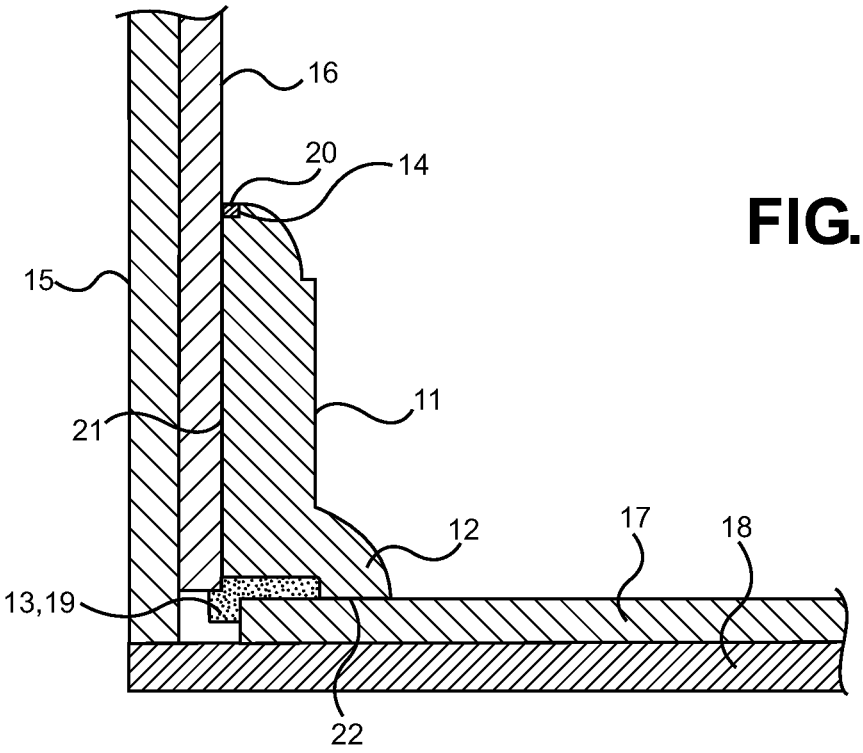
FIG. 3 is a cross section view of the present invention in its installed state along the base of a wall in a room.

Referring now to FIG. 3, there is shown a cross section view of the present invention in its installed state along the base of a wall in a room. When tacking a baseboard section to the wall surface, the backside and the lower side of the baseboard presses against the wall surface 16 and the flooring surface 17 respectively, at which point the compressible insulating material 13 presses into any corner gaps 19 that may exist between the flooring and the wall. The insulating material 13 molds and expands to fit into the corner gap space 19 under the baseboard, thereby insulating the space. The filled gap results in an improvement in thermal efficiency of the interior space attributable to the preventing heat transfer across the baseboard boundary.

Once the baseboard is securely tacked to the wall, an installer introduces caulk 20 into the upper caulking channel 14 located at the junction of the backside and the decorative outer side of the baseboard. Caulking the top of the baseboard serves two purposes: first, it is common that a baseboard does not lie flush with a wall surface upon installation of the baseboard. Introducing caulk into the caulking channel will fill any unsightly gaps between the baseboard and the wall surface; secondly, in addition to the compressible insulating material located at the lower backside of the baseboard, which presses into the corner gap at the junction of the wall and the floor surface, the caulk serves as an additional insulation mechanism. Sealing any gaps that may exist between the top of the baseboard and the wall surface reduces air infiltration into a room. Before the caulk sets, an installer smoothes the caulk such that there is no visible seam between the top of the baseboard and the wall. A coating of paint is often desirable as a final step to the installation process as the paint gives the newly installed baseboard a flawless exterior finish.

Figure 4:
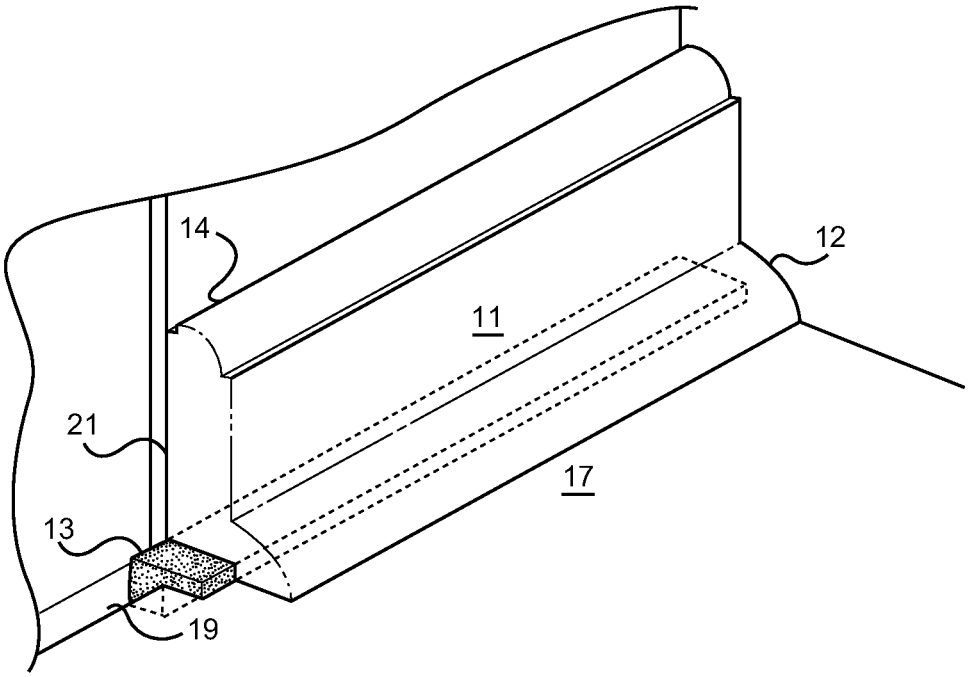
FIG. 4 is a perspective cross sectional view of the present invention in an installed state along the base of a wall in a room.

Referring now to FIG. 4, there is shown a perspective cross section view of the present invention in an installed state along the base of a section of wall in a room. The compressible insulating material 13 is pressed into the corner gap 19 between the wall and the flooring 17. The caulking channel 14 is ready for a quantity of caulk before finalizing the transition between the top of the baseboard and the wall surface. Once installed, any air gaps along the corners of a room are sufficiently sealed to prevent drafts, while the outer surface provides an appealing, decorative appearance that is a popular finishing touch to a room. The present invention can be manufactured in a variety of decorative styles, shapes and sizes and can be made from a variety of materials such as, but not limited to, composites, plastic or milled wood. The present invention may also serve as crown molding for use at the top of wall surfaces, abutting the ceiling.

The disclosed baseboard structure comprises air gap insulation, an integrated quarter-round molding segment, and an upper caulk channel for providing a unitary baseboard element for quick and easy installation. The baseboard comprises an outer, decorative surface having an integrated quarter round element, a lower surface adapted to lie flush on the floor surface, a backside surface adapted to lie flush with the wall surface and a caulk channel located at the junction of the backside and outer decorative surface of the baseboard. A section of compressible insulation material is situated at the junction of the backside and lower surfaces of the baseboard, and is adapted to press into any corner gaps between the flooring and the wall to seal any air gaps or gaps in thermal resistance. The device incorporates a caulking channel such that the installer conceals any gaps that exist between the baseboard and the wall surface when the baseboard is tacked flush against the floor. Introducing caulk into the caulking channel also creates a seamless transition between the top of the baseboard and the wall surface. The present invention provides improved insulating capabilities reduces steps in the installation process and allows for the rapid installation of baseboards in a room.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A molding structure, comprising:

a baseboard having a length, an outer surface, a vertical backside surface and a horizontal lower surface;

a quarter-round molding segment integrated along a lower end of said outer surface;

wherein said quarter-round molding segment is of unitary construction with said baseboard length;

a channel located at a junction of said backside surface and said outer surface, adapted to receive a quantity of filler material and extending along said baseboard length, wherein said channel is a cut-out extending downward from said outer surface at an apex of said baseboard;

a strip of insulating material located at a junction of said vertical backside surface and said horizontal lower surface, extending along said baseboard length;

wherein said insulating material is sized to protrude below said horizontal lower surface and align flush with said vertical backside surface;

wherein said insulating material is selected from the group consisting of foam, rubber, insulating board, and spun insulating fibers wherein said horizontal lower surface is a lowermost horizontal surface of the baseboard.

2. The device of claim 1, wherein said outer surface further comprises a decorative appearance or contour.

3. The device of claim 1, wherein said horizontal lower surface is adapted to lie flush against a floor surface and said vertical backside surface is adapted to be pressed against an upstanding wall surface, wherein said insulating material is compressible and adapted to fill any gaps between said floor surface and said upstanding wall surface.

* * * * *